US009831049B2

(12) United States Patent
Lin et al.

(10) Patent No.: US 9,831,049 B2
(45) Date of Patent: Nov. 28, 2017

(54) KEY STRUCTURE AND KEYBOARD HAVING THE SAME

(71) Applicant: Chicony Electronics Co., Ltd., New Taipei (TW)

(72) Inventors: Chun-Ting Lin, New Taipei (TW); Chieh-Fan Chuang, New Taipei (TW); Liang-Chun Yeh, New Taipei (TW); Chun-Te Lee, New Taipei (TW)

(73) Assignee: CHICONY ELECTRONICS CO., LTD., New Taipei (TW)

( * ) Notice: Subject to any disclaimer, the term of this patent is extended or adjusted under 35 U.S.C. 154(b) by 0 days.

(21) Appl. No.: 14/991,945

(22) Filed: Jan. 9, 2016

(65) Prior Publication Data

US 2017/0125186 A1 May 4, 2017

(30) Foreign Application Priority Data

Oct. 28, 2015 (TW) ..... 104135501 A

(51) Int. Cl.
*H01H 3/12* (2006.01)
*H01H 13/14* (2006.01)

(52) U.S. Cl.
CPC ..... *H01H 13/14* (2013.01); *H01H 2205/002* (2013.01); *H01H 2221/044* (2013.01)

(58) Field of Classification Search
CPC ..... H01H 13/14; H01H 9/26; H01H 13/72; H01H 13/76; H01H 13/00; H01H 13/02; H01H 13/70; H01H 13/12; H01H 13/20; H01H 13/50; H01H 13/7006; H01H 13/705; H01H 13/86; H01H 2003/00; H01H 2201/00; H01H 2219/036; H01H 2233/033; H01H 21/36; H01H 36/004; H01H 36/02; H01H 2221/00; H01H 1/00; H01H 1/12; H01H 1/22; H01H 1/221; H01H 1/225; H01H 3/00; H01H 3/02; H01H 3/12
USPC ..... 200/341, 5 R, 5 A, 46, 406, 511–514, 200/520–521, 308, 310–314, 317, 337, 200/345
See application file for complete search history.

(56) References Cited

U.S. PATENT DOCUMENTS 6,236,003 B1 * 5/2001 Suganami ..... H01H 3/125 200/344
2010/0252407 A1 * 10/2010 Merminod ..... H01H 13/83 200/5 A
2012/0298496 A1 * 11/2012 Zhang ..... H01H 3/125 200/5 A

FOREIGN PATENT DOCUMENTS

TW 378767 U 1/2000
TW M482833 U 7/2014

* cited by examiner

*Primary Examiner* — Anthony R Jimenez
(74) *Attorney, Agent, or Firm* — Chun-Ming Shih; HDLS IPR Services

(57) ABSTRACT

A key structure includes a carrying body, a frame body, a keycap and at least two independent connecting members. The frame body is disposed on the carrying body and forms plurality of sliding grooves. The keycap has a plurality of cap edges and is disposed with a plurality of pivoting portions. The at least two connecting members are each connected between the keycap and the frame body, corresponding to two of the cap edges opposite to each other. Each connecting member includes a pivoting rod and a sliding rod. Each pivoting rod pivots on one of the pivoting portions, and each sliding rod is slidably limited in one of the (Continued)

sliding grooves. This design has preferred structural strength, smooth pressing movement and reliable pressing contact.

18 Claims, 16 Drawing Sheets

KEY STRUCTURE AND KEYBOARD HAVING THE SAME

TECHNICAL FIELD

The disclosure relates to a key structure for a keyboard, more particularly to a key structure with preferred structural strength, smooth pressing movement and reliable pressing contact, and a keyboard having the key structure.

BACKGROUND

Currently the key on a keyboard generally comprise a substrate, a keycap and a connecting component movably connected between the substrate and the keycap. The connecting component has a space for an elastic member to go through and move and the elastic member elastically supports between the keycap and the substrate. The substrate is disposed with a circuit layer. The circuit layer is disposed with a switch corresponding to the elastic member. When the keycap is pressed by a finger, the connecting component guides the keycap to move downward and the elastic member is in contact with the trigger switch, thereby reaching the goal of generating a signal by tapping the keys of the keyboard.

As shown in FIG. 15 from a Taiwan patent number TW378767, it discloses an improved structure for the key of the computer. From top to bottom, the key structure comprises a keycap, a connecting component of scissor style, a U-shaped stand, an elastic member, a circuit layer and a substrate. However, it has following drawbacks: (1) Due to the connecting component of scissor style, the U-shaped stand must be in the U shape (the right side of the U-shaped stand forms an opening) and it cannot be designed as a surrounding frame, which results in insufficient structural strength of the U-shaped stand. There is a deformation when being pressed and this affects the action of the connecting component of scissor style. Thereby, the movement of the key being pressed is not smooth and the pressing contact thereof is not reliable; (2) Since the U-shaped stand is utilized, the front and rear sides thereof respectively form two axis holes which are recessed. As a result, only the connecting component of scissor style can be used here and other types of connecting components are not suitable for this design; (3) The lower end foot on the left side of the connecting component of scissor style rubs the substrate. The connecting component is made of plastics while the substrate is made of metal, so that the issue of abrasion of the connecting component of scissor style arises; (4) The connecting component of scissor style must form the opening for accommodating the elastic member, which results in insufficient structural strength of the connecting component of scissor style which tends to slant when being pressed; (5) For fixing the U-shaped stand and positioning the connecting component of scissor style, the circuit layer and the substrate form many holes which are not ideal for waterproof, dust-proof and circuit layout of the circuit layer.

As shown in FIG. 16 from a Taiwan patent publication number TWM482833, it discloses a key structure in which the top side of the metal bending rod pivots on the keycap while the bottom side of the metal bending rod is sildably connected on the sliding groove of the boost plate, thereby forming the connecting component connected between the keycap and the bottom plate. Additionally, the elastic member is disposed between the keycap and the bottom plate to form the key structure. Nonetheless, it has following problems: (1) The metal bending rod is merely a metal wire of which the structural strength is not enough, and it must go through bending molding which is not easy to manufacture and is costly. Also, the precision of manufacturing is hard to control and this therefore affects the yield rate negatively; (2) In the matching between the metal bending rod and the bottom plate, the former is made of metal while the latter is made of plastics so the abrasion of the sliding groove of plastics emerges. In the long run, this abrasion causes the loose connection in terms of the sliding connection. Furthermore, if the bottom plate is made of metal, the metal slides on the metal results in abrasion which affects the durability of the products and harsh noises which bothers the users when operation; (3) For the slim design of the keyboard, the size of the metal bending rod has to be reduced but this makes it even harder to manufacture; (4) Since the metal bending rod serves as the connecting component between the keycap and the bottom plate, it leads to unstable structure, size not easy to control and insufficient precision. Thereby, the movement of the key being pressed is not smooth and the pressing contact thereof is not reliable, and all the actions are done on the bottom plate. Moreover, many unnecessary holes are formed which are not ideal for waterproof, dust-proof and circuit layout of the circuit layer.

Consequently, it is important to provide an improved design for solving the aforementioned problems.

SUMMARY

The disclosure provides a key structure which makes the frame body and the connecting member have preferred structural strength and make all actions focus on the frame body. This will lead to smooth movement when pressing the key and reliable pressing contact.

Accordingly, the disclosure provides a key structure comprising a carrying body, a frame body, a keycap and at least two independent connecting members. The frame body is disposed on the carrying body, and the frame body is disposed with either a plurality of sliding grooves or a plurality of pivoting portions. The keycap has a plurality of cap edges. The keycap is disposed with the other of the sliding grooves and the pivoting portions. The at least two connecting members are connected between the keycap and the frame body, corresponding to two of the cap edges opposite to each other. Each connecting member comprises a pivoting rod and a sliding rod. Each pivoting rod pivots on one of the pivoting portions, and each sliding rod is slidably limited in one of the sliding grooves.

The disclosure further provides a keyboard comprising a plurality of keys. At least one of the keys is the key structure mentioned above.

Compared to the prior art, the disclosure has the following effects: because of the frame body and the multiple connecting members are independent with each other and without any hole, the disclosure has preferred structural strength. In addition, the actions focus on the frame body so when pressing the key, the pressing movement is smooth and the pressing contact is reliable.

In order to further understand the instant disclosure, the following embodiments are provided along with illustrations to facilitate the appreciation of the instant disclosure; however, the appended drawings are merely provided for reference and illustration, without any intention to be used for limiting the scope of the instant disclosure.

BRIEF DESCRIPTION OF THE DRAWINGS

The disclosure will become more fully understood from the detailed description and the drawings given herein below for illustration only, and thus does not limit the disclosure, wherein.

DETAILED DESCRIPTION

Figure 1:
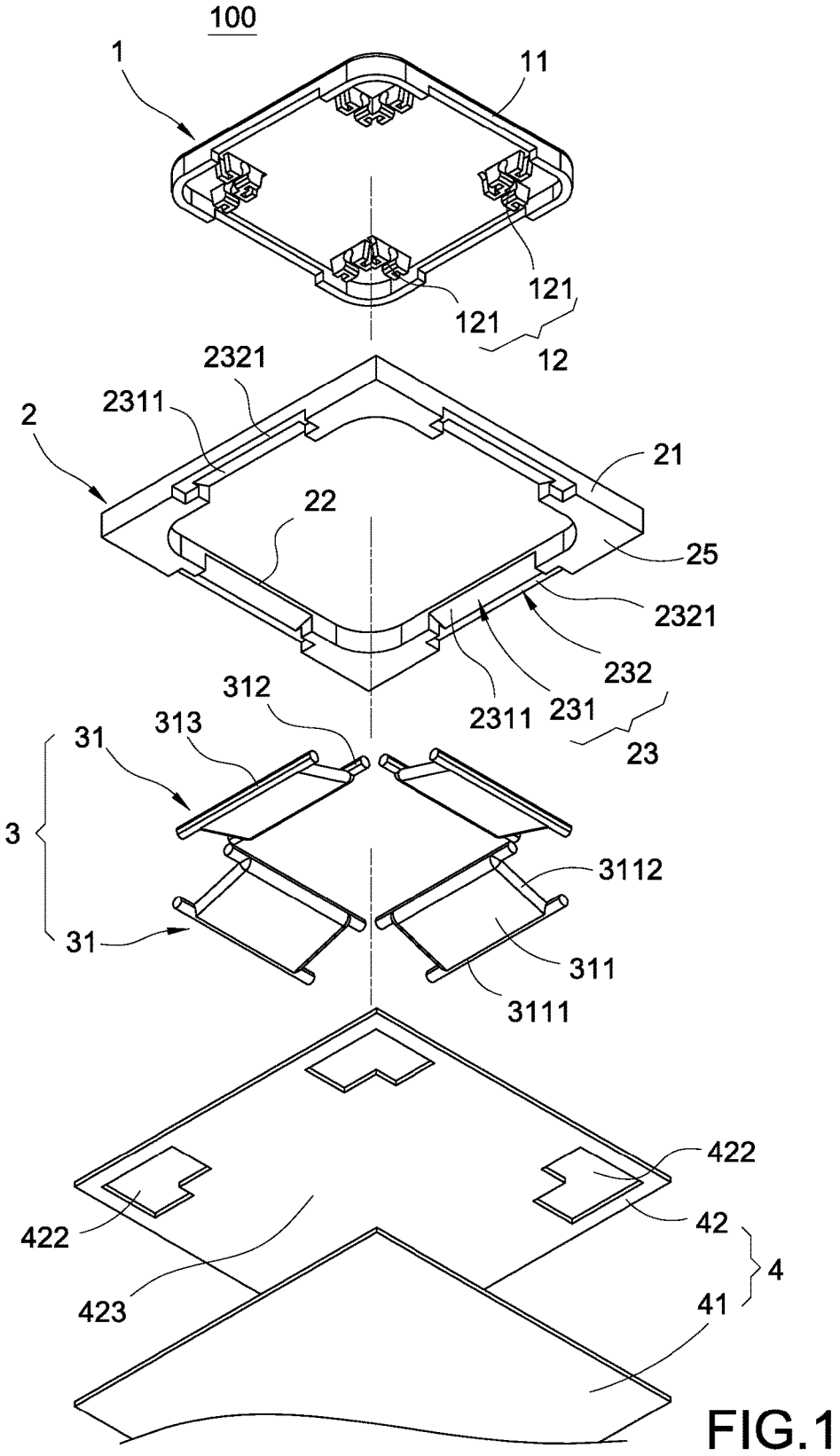
FIG. 1 is an exploded view of the first embodiment of the disclosure (omitting the elastic member)

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Figure 7:
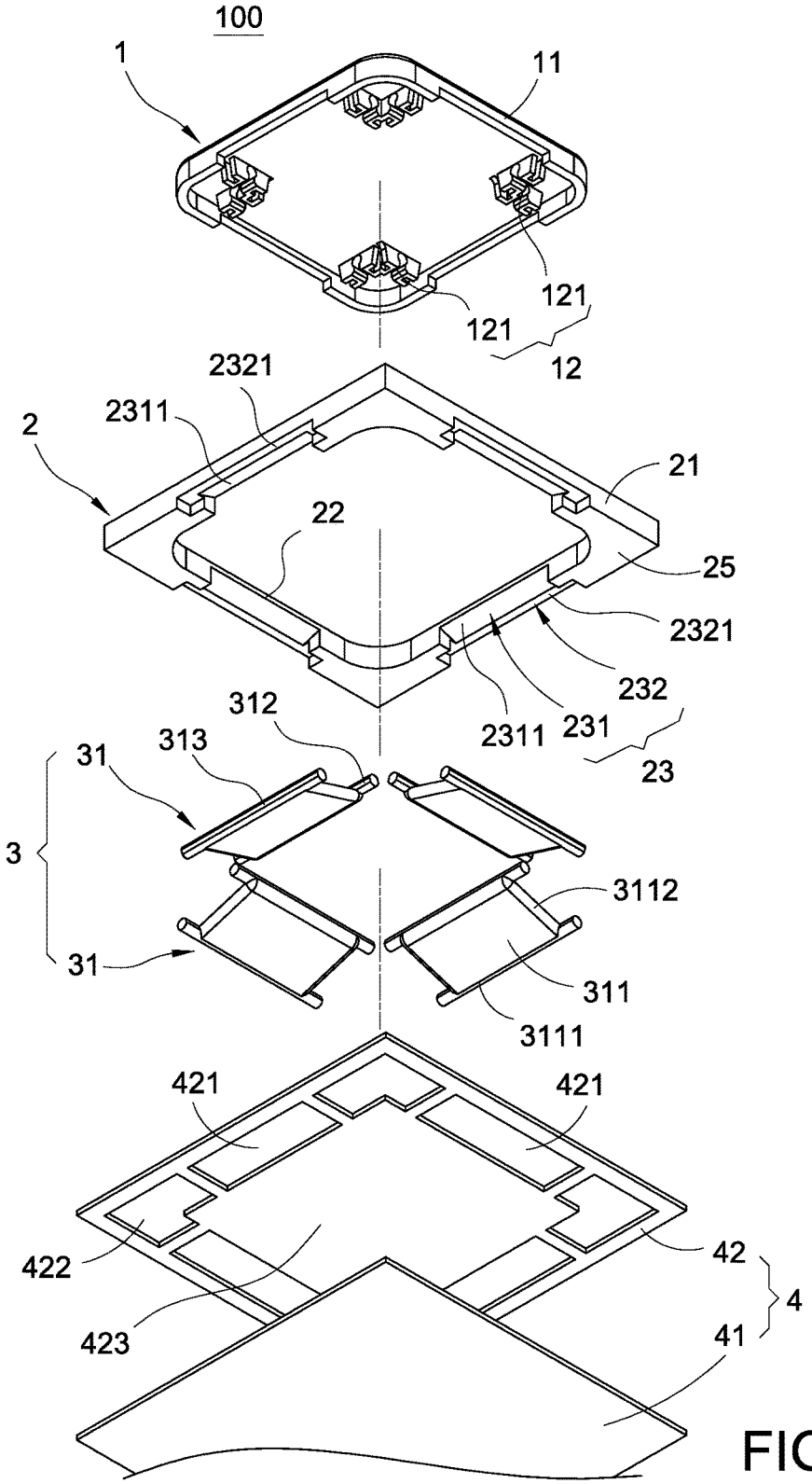
FIG. 7 is an exploded view of the second embodiment of the disclosure (omitting the elastic member)
Figure 8:
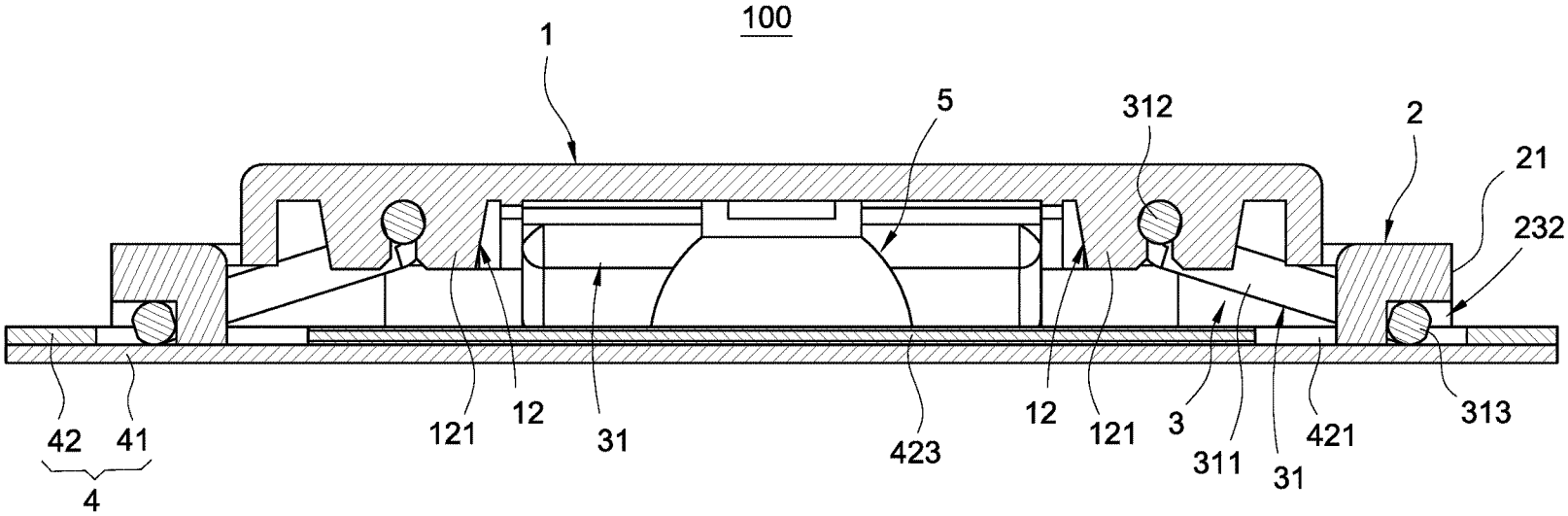
FIG. 8 is a sectional view of FIG. 7 after assembly.
Figure 9:
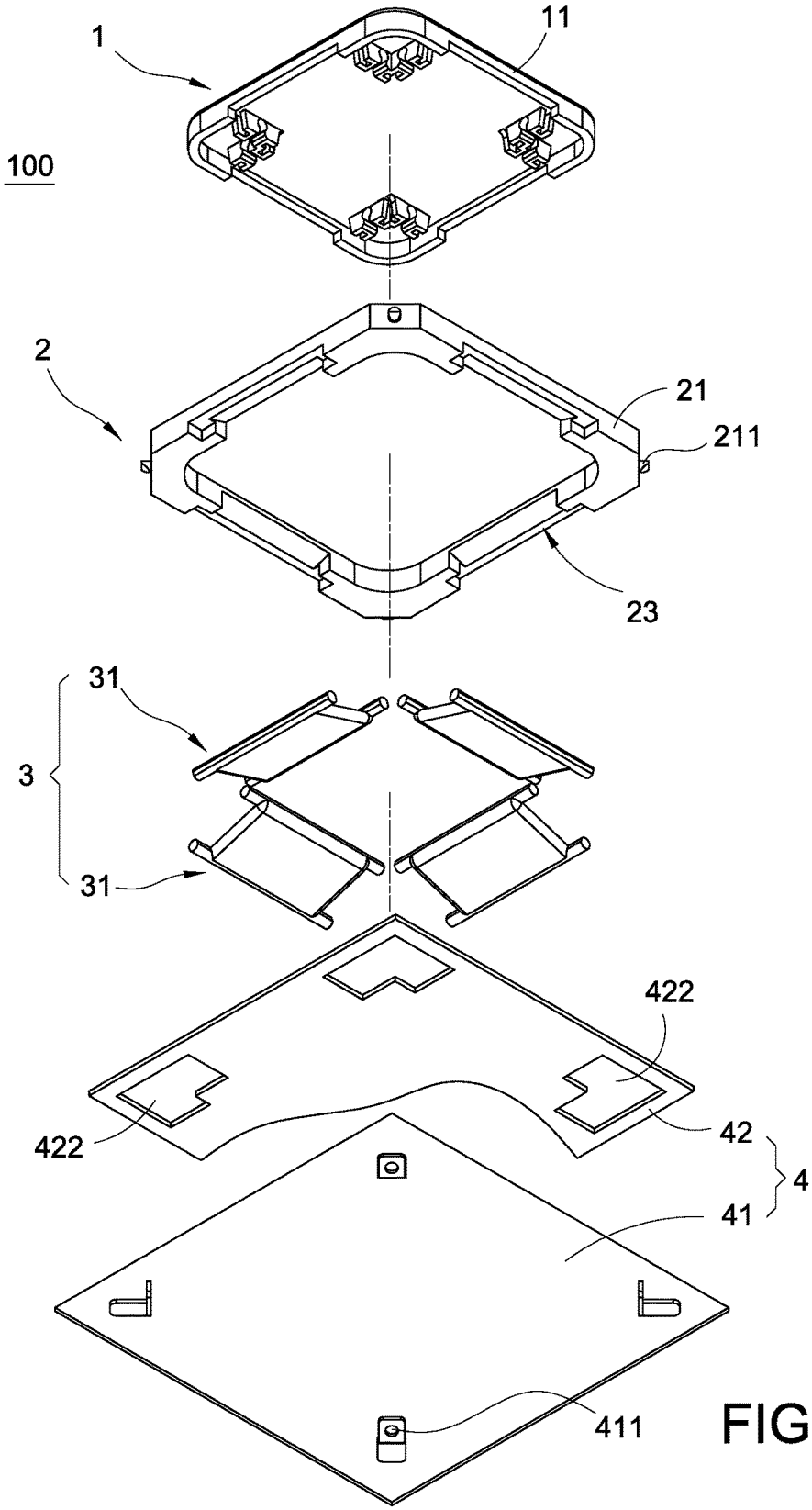
FIG. 9 is an exploded view of the third embodiment of the disclosure (omitting the elastic member)
Figure 10:
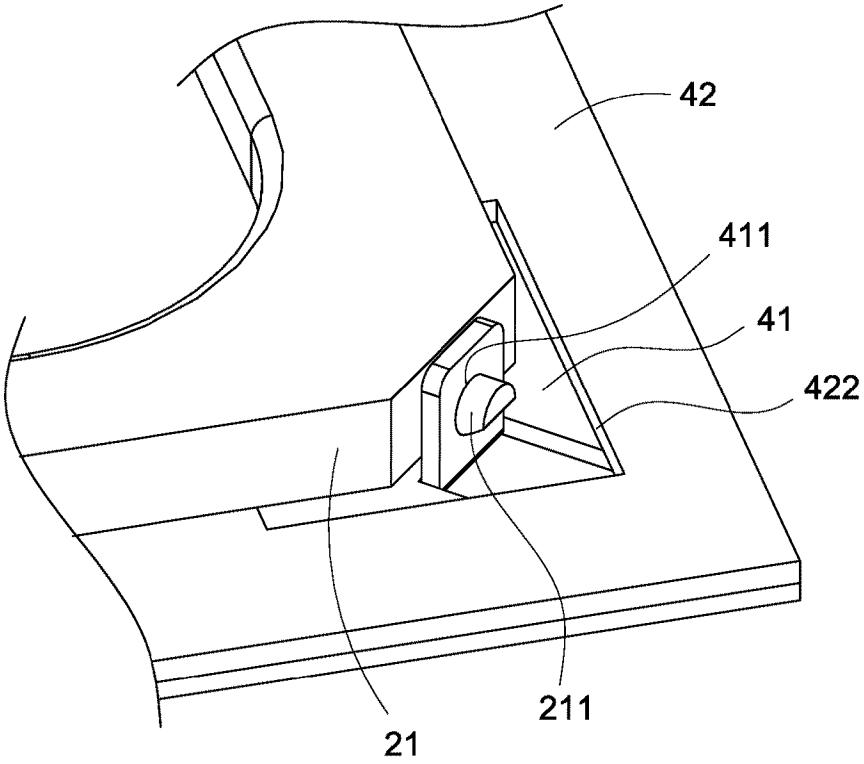
FIG. 10 is a partial perspective view of the disclosure according to FIG. 9.
Figure 11:
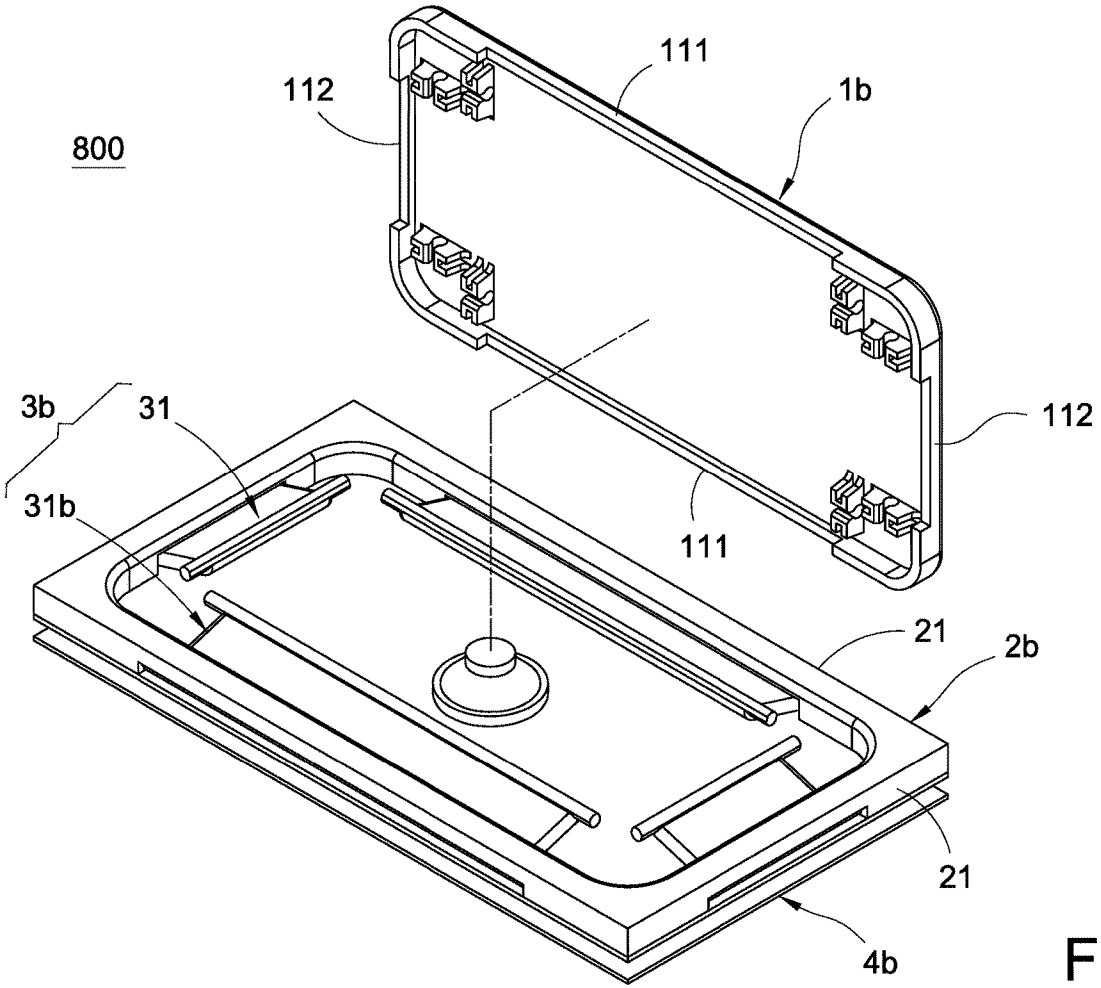
FIG. 11 is a partial exploded view of the fourth embodiment of the disclosure (omitting the elastic member)
Figure 12:
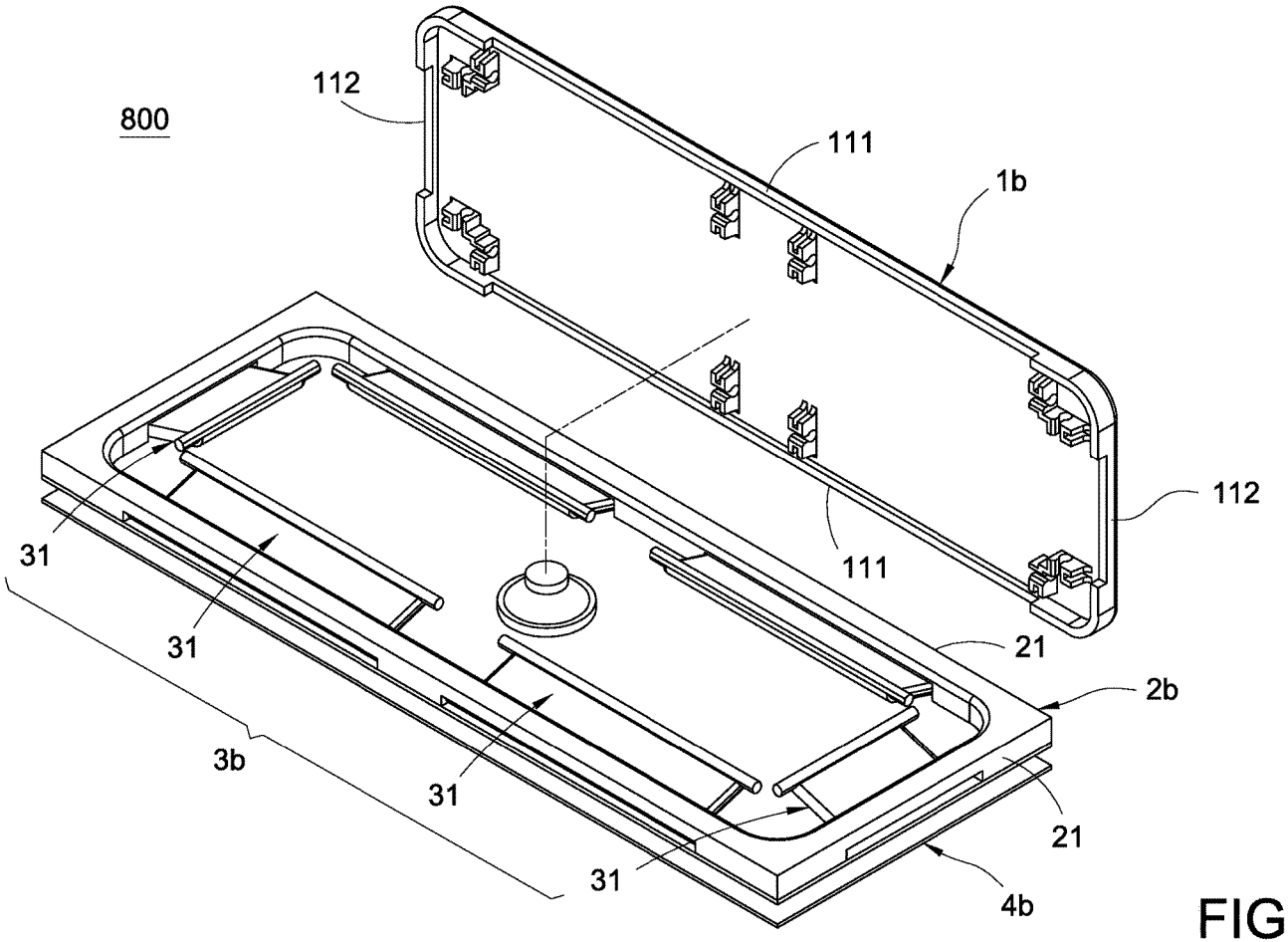
FIG. 12 is a partial exploded view of the fifth embodiment of the disclosure (omitting the elastic member)
Figure 13:
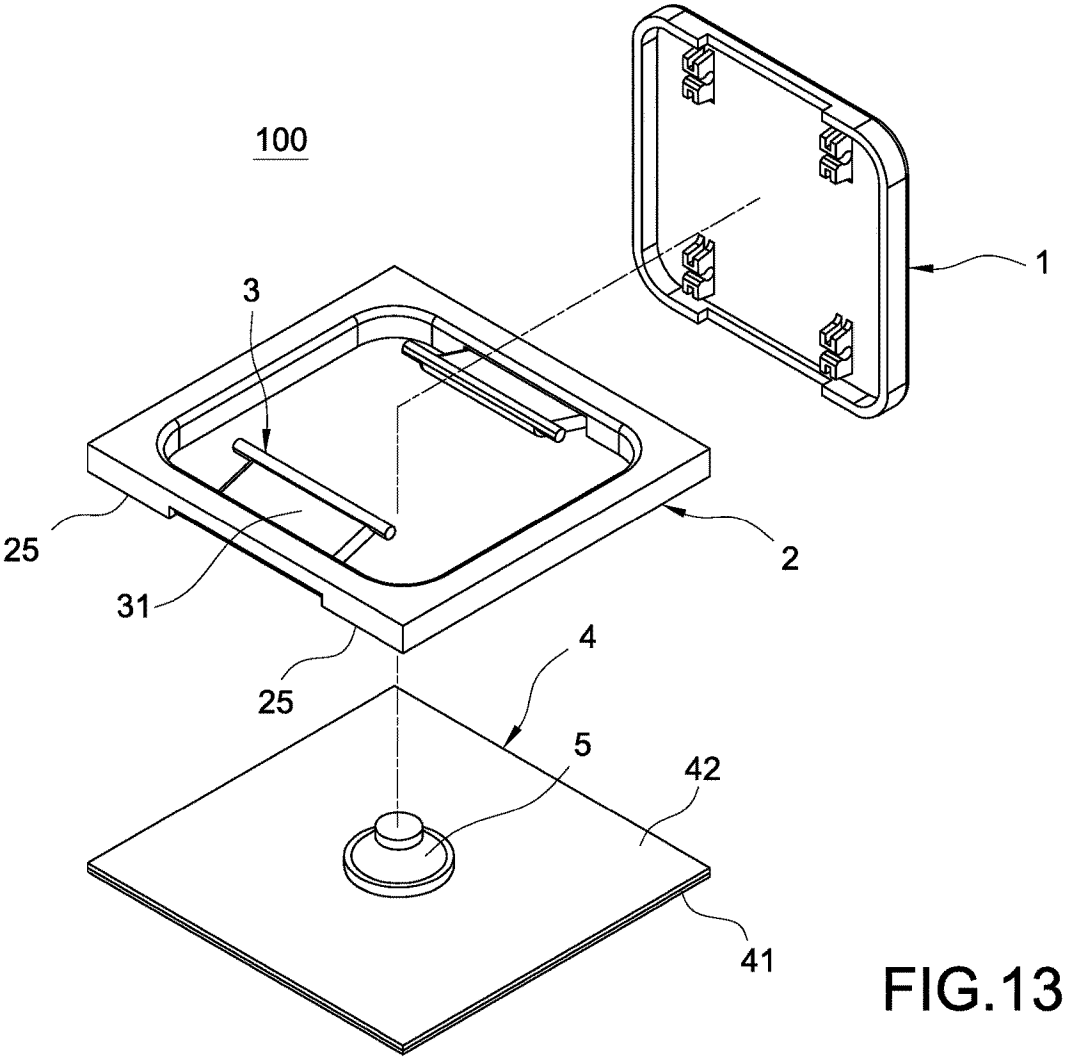
FIG. 13 is an exploded view of the sixth embodiment of the disclosure.
Figure 14:
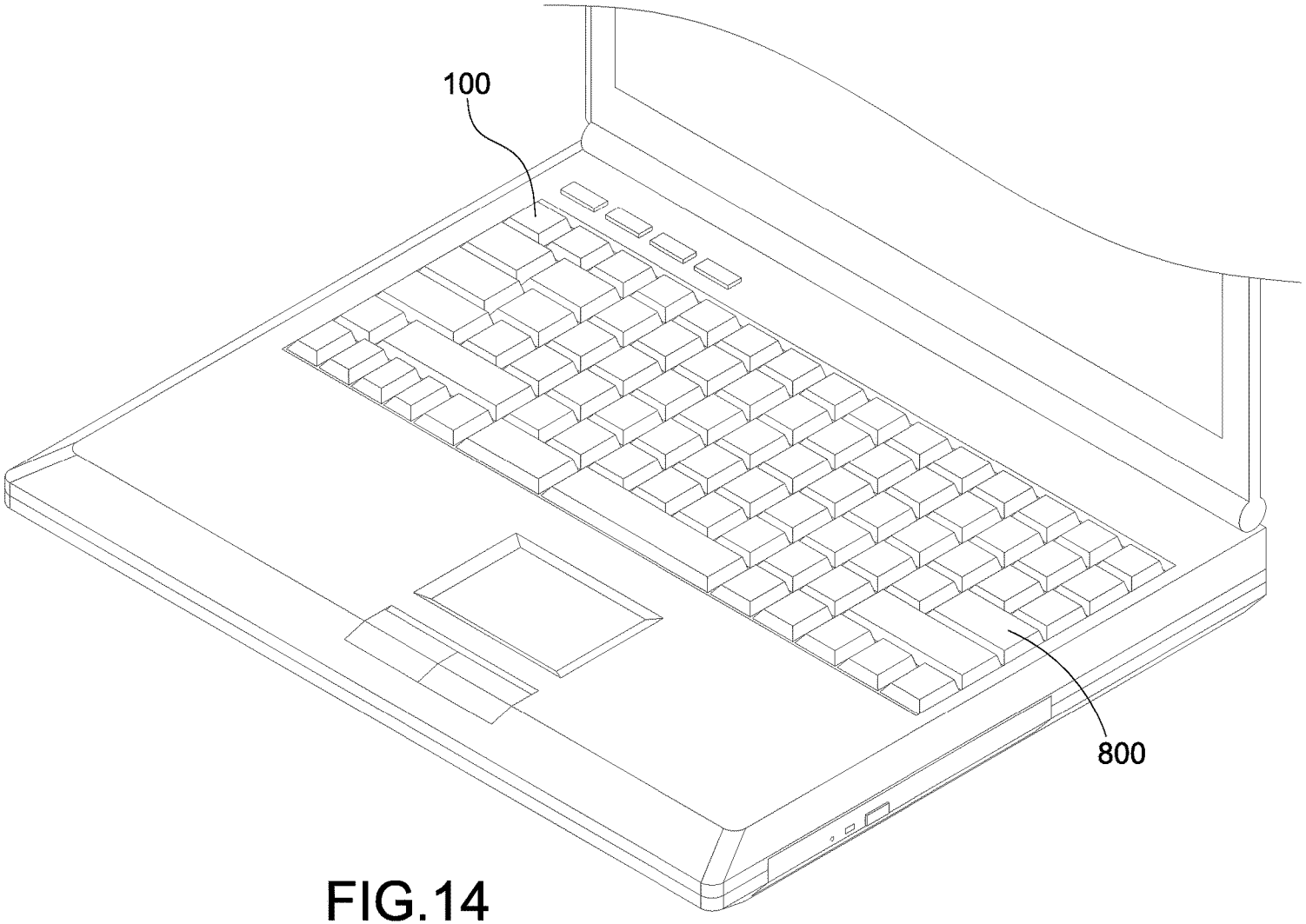
FIG. 14 is a perspective view of the appearance of the disclosure applying on the keyboard.
Figure 15:
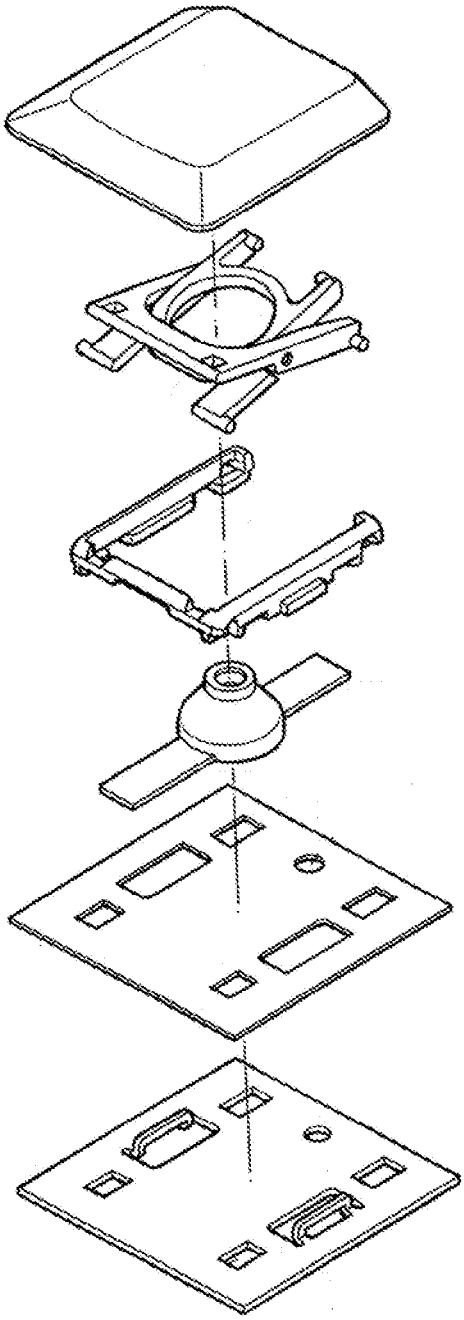
FIG.15 (RELATED ART)
FIG. 15 is a prior art of a Taiwan patent of which the certification number is 378767.
Figure 16:
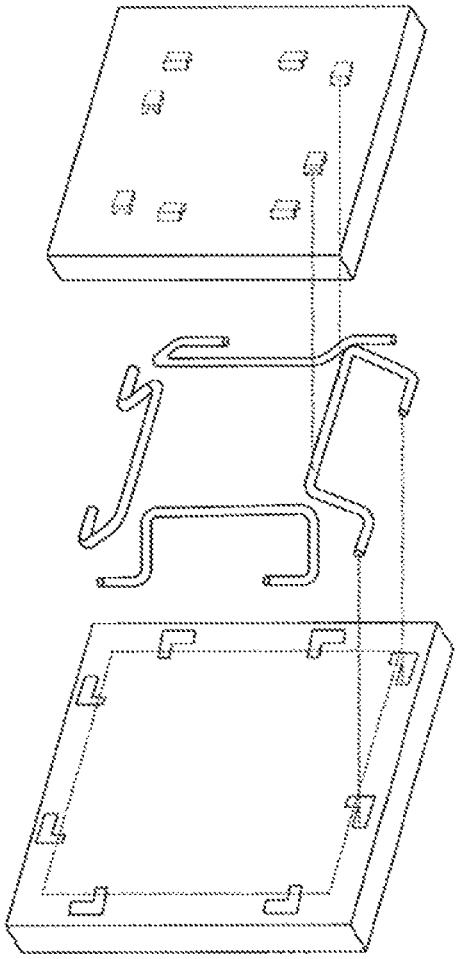
FIG.16 (RELATED ART)
FIG. 16 is a prior art of a Taiwan patent of which the certification number is M482833.

The disclosure provides a key structure and a keyboard having the key structure. FIG. 1 to FIG. 6 show the first embodiment of the disclosure. FIG. 7 and FIG. 8 show the second embodiment of the disclosure. FIG. 9 and FIG. 10 show the third embodiment of the disclosure. FIG. 11 shows the fourth embodiment of the disclosure. FIG. 12 shows the fifth embodiment of the disclosure. FIG. 13 shows the fifth embodiment of the disclosure. FIG. 14 illustrates the disclosure applying on the keyboard. Specifically, the keyboard may be a normal independent keyboard or a keyboard arranged on a laptop, for example, and the disclosure is not limited thereto. The keyboard comprises a plurality of keys and at least one of these keys is the key structure illustrated below.

Figure 2:
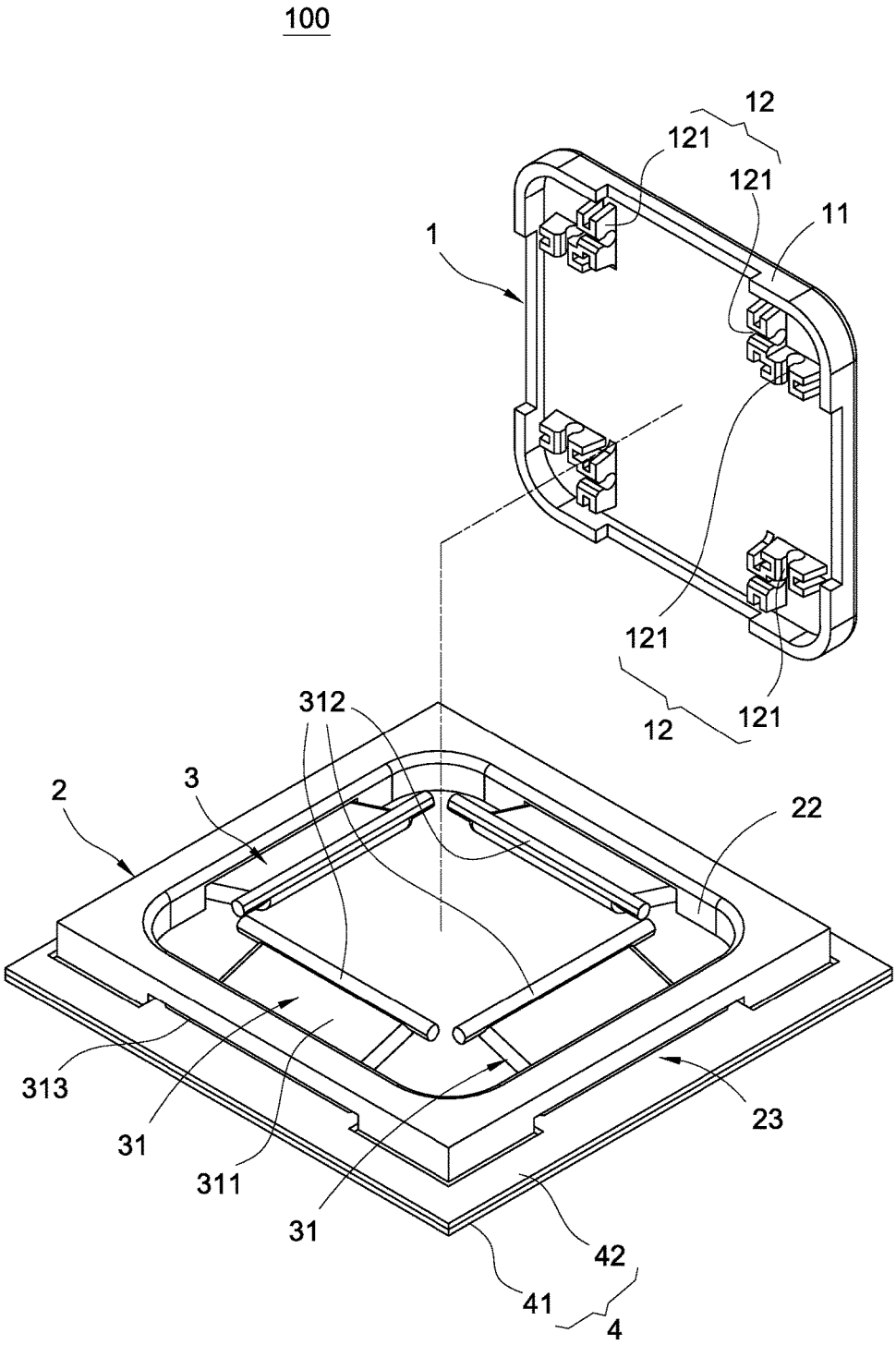
FIG. 2 is a perspective view of the partial assembly of the first embodiment of the disclosure according to FIG. 1.
Figure 3:
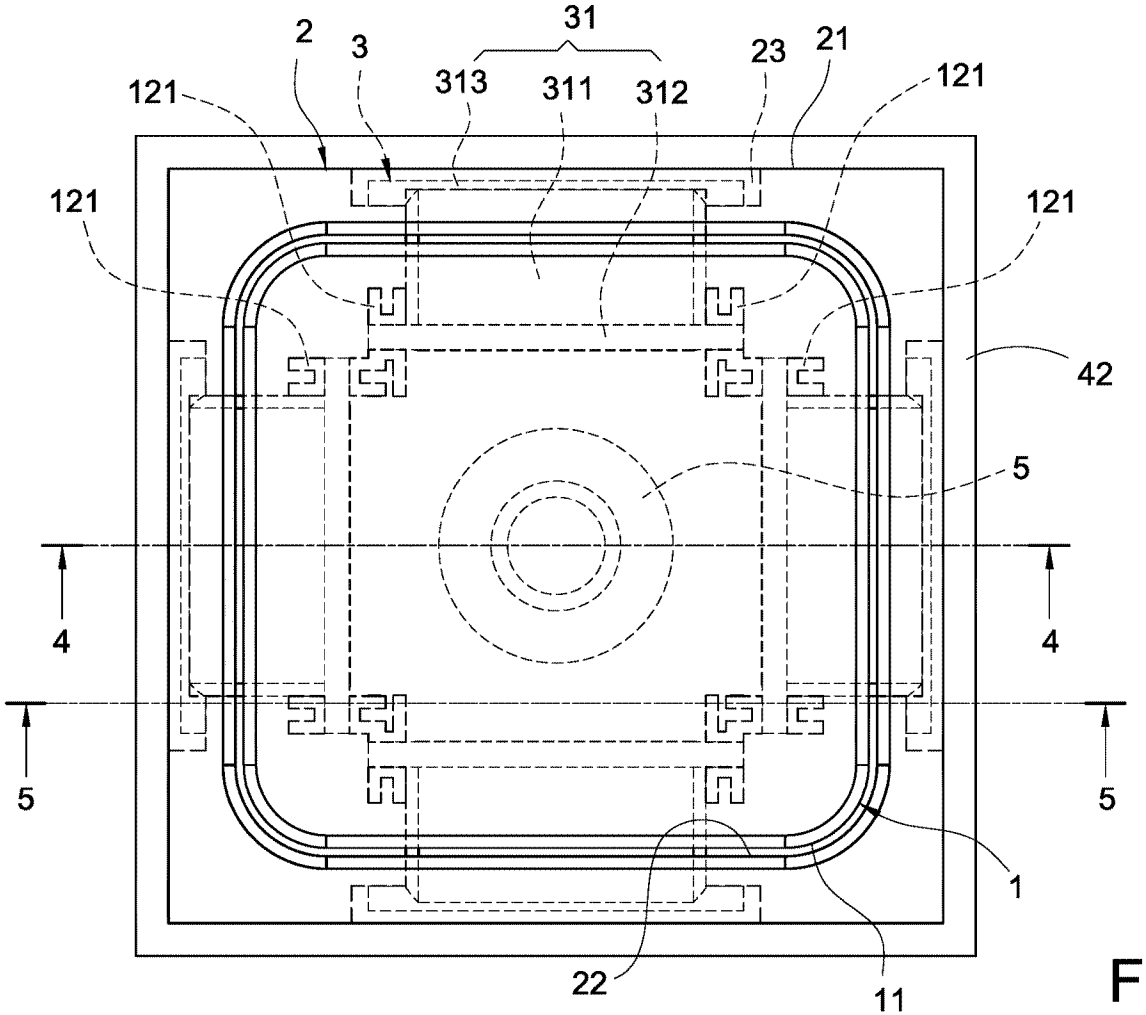
FIG. 3 is a top view of FIG. 1 after assembly (including the elastic member)
Figure 4:
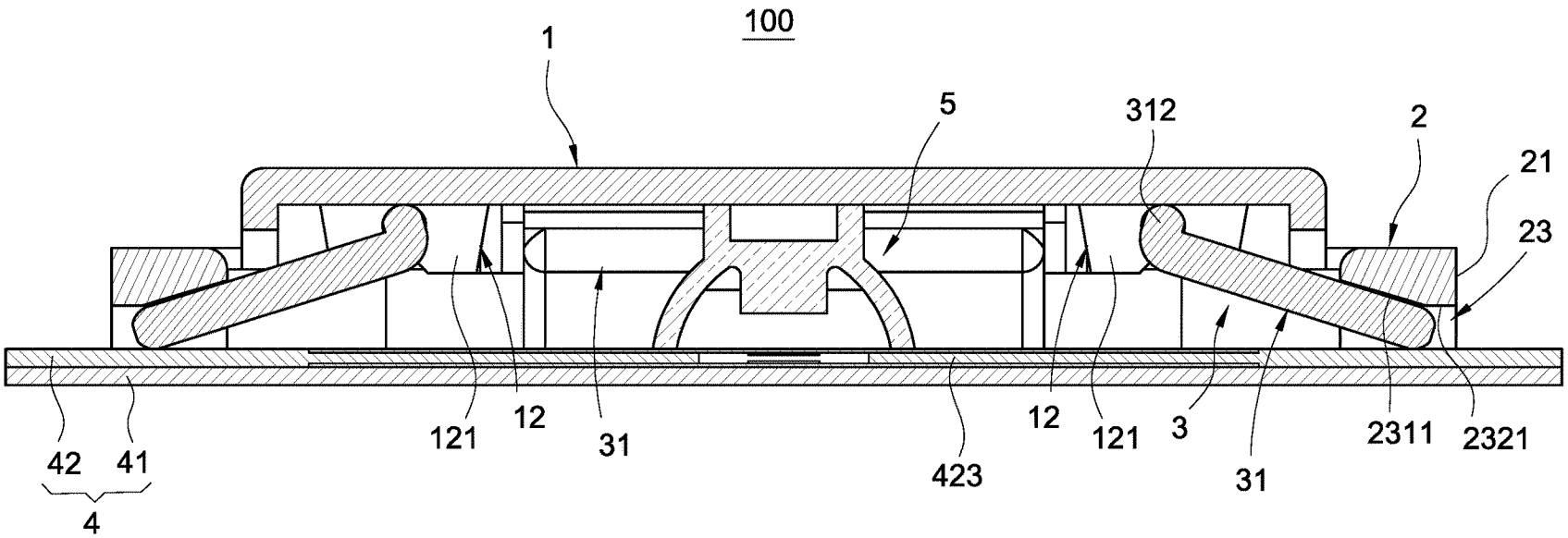
FIG. 4 is a sectional view of FIG. 3 along the cutting line 4-4.

The key structure 100 of the first embodiment of the disclosure, as shown in FIG. 1, FIG. 2, FIG. 3, FIG. 4 and FIG. 5, comprises a keycap 1, a frame body 2, a connecting assembly 3, a carrying body 4 and an elastic member 4. As shown in FIG. 4, the size of the frame body 2 is larger than the size of the keycap 1 such that the frame body 2 is surroundingly arranged with respect to the keycap 1.

The carrying body 4 is configured for carrying the keycap 1, the frame body 2, the connecting assembly 3 and the elastic member 5. The carrying body 4 comprises a bottom plate 41 and a membrane circuit board 42 stacked on the bottom plate 41. The manner of the stacking of the membrane circuit board 42 and the bottom plate 41 is not limited in the disclosure. In the instant embodiment, the membrane circuit board 42 is stacked on the bottom plate 41, for example. Furthermore, the carrying body 4, according to need, can be arranged with a plurality of keycaps 1, a plurality of frame bodies 2, a plurality of connecting assemblies 3 and a plurality of elastic members 5, for forming a keyboard or a set of keys. In this embodiment, only a single key is illustrated as an example, and the disclosure is not limited thereto.

The keycap 1 is for a user to press and can be a keycap of standard keys (e.g., English alphabet or Arabic numbers) or a keycap of the multiple-width key (e.g., Enter key, Backspace key, Shift key or spacebar), and the disclosure is not limited thereto. In this embodiment, the keycap of standard keys is used as an example. The keycap 1 has a plurality of cap edges 11 to form the polygonal keycap 1. In this embodiment, a rectangular keycap 1 formed by four cap edges 11 is used as an example. The bottom face of the keycap 1 is disposed one pivoting portion 12 for each of the cap edges 11. The disclosure is not limited to the specific structure of the pivoting portion 12. The pivoting portion 12 of this embodiment includes two pivoting bodies 121 spaced apart from each other, as a specific example.

The frame body 2 is a unit with a surrounding frame shape. The frame body 2 comprises four frame edges 21 corresponding to the keycap 1 and is in a rectangular shape. The frame body 2 further has four inner edges 22 corresponding to the four frame edges 21, respectively. The frame body 2 is disposed on the carrying body 4, wherein the disclosure is not limited to the frame body 2 being disposed on the bottom plate 41 of the carrying body 4 or being disposed on the membrane circuit board 42, as long as the frame body 2 and the carrying body 4 are stably connected. In this embodiment, the frame body 2 is disposed on the bottom plate 41 and the frame body 2 and the bottom plate 41 are connected via welding or mounting connection. The membrane circuit board 42 is disposed between the frame body 2 and the bottom plate 41. For instance, the frame body 2 and the bottom plate 41 can be connected to each other by a welding structure or a mounting structure. It should be noted that, the number, position and size of the aforementioned welding structure or mounting structure may be altered according to need. Hence, the membrane circuit board 42 only needs to be partially formed with holes 431 corresponding to the aforementioned welding structure or mounting structure. The middle section of the membrane circuit board 42 does not have any hole. Hence, smaller or less amount of welding structures and mounting structures may effectively reduce the number and the size of the holes formed on the membrane circuit board 42, thereby improving the performance of waterproof and dust-proof. Moreover, it increases the area of circuit layout of the membrane circuit board 42. The wording of "partially formed with holes" means that the holes 431 just need to be slightly larger than the welding structure or mounting structure.

The bottom face of the frame body 2 is formed with four sliding grooves 23 corresponding to the frame edges 21 respectively. The other part of the bottom face of the frame body 2, which is not formed with the four sliding grooves 23, is formed with a plurality of fixing portions 25. The parts of the portions of the membrane circuit board 42 corresponding to the fixing portions 25 each form a hole 422 so that the fixing portions 25 of the frame body 2 can each be disposed on the bottom plate 41 via the hole 422. The preferred way for this arrangement is by welding or by mounting, and the disclosure is not limited thereto. Additionally, the part of the membrane circuit board 42 surrounded by the holes 431 forms the middle section 423, which is formed without any hole. Specifically, as shown in FIG. 1, the part surrounded by the inner edges 22 of the membrane circuit board 42 corresponding to the frame body 2 is defined as the middle section 423. As shown in FIG. 4, each sliding groove 23 is located outside the corresponding pivoting portion 12, that is, the frame body 2 is larger than the keycap 1.

Each of the sliding grooves 23 comprises an inner sliding groove 231 and an outer sliding groove 232, which are adjacent to each other and arranged side by side. Each of the inner sliding grooves 231 is connected to the corresponding the inner edge 22, and each of the outer sliding grooves 232 is in communication with the corresponding inner sliding groove 231. Moreover, the length of the outer sliding groove 232 is longer than the length of the inner sliding groove 231 such that the two ends of the outer sliding groove 232 protrude from the two ends of the inner sliding groove 231 respectively. As seen in the figure, the outer sliding groove 232 can be connected to the frame edge 21. In an alternative embodiment, the outer sliding groove 232 may not be connected to the frame edge 21 (not shown in the figure), as long as the outer sliding groove has sufficient space.

The parts of the frame body 2 corresponding to the inner sliding grooves 231 each have an inclined face 2331, and the parts of the frame body 2 corresponding to the outer sliding grooves 232 each have a flat face 2321. The inclined face 2331 and the flat face 2321 are arranged side by side and are proximal to each other. Each of the inclined faces 2331 inclines from the one of the frame edges 21 towards the corresponding inner edge 22 (as seen in FIG. 4 and FIG. 1).

The connecting assembly 3 comprises at least two connecting members 31 opposite and independent of each other. Each connecting member 31 is a sheet structure and is connected, corresponding to one of the cap edges 11, between the keycap 1 and the frame body 2. Specifically, from the keycap 1, each connecting member 31 outwardly protrudes from one of the cap edge 11 and extends towards the corresponding frame edge 21 of the frame body 2. The frame edges 21 of the frame body 2 are surroundingly arranged at the outside of the cap edges 11. Hence, when the keycap 1 is pressed and move downwardly relative to the bottom plate 41 (the state seen in FIG. 6), the keycap 1 may be accommodated by the frame body 2. The connecting assembly 3 of this embodiment comprises four connecting members 31. The connecting members 31 each comprise a plate sheet 311, a pivoting rod 312 and a sliding rod 313. The plate sheet 311 is preferably in a rectangular shape and has two connecting edges 3111 opposite to each other and two lateral edges 3112 opposite to each other.

The main parts of the pivoting rod 312 and the sliding rod 313 are disposed on the two connecting edges 3111 of the connecting member 31, respectively. The two ends of the pivoting rod 312 respectively protrude from the two lateral edges 3112 of the connecting member 31, thereby pivoting on the two pivoting bodies 121 of the pivoting portion 12. The two ends of the sliding rod 313 also protrude from the two lateral edges 3112 of the connecting member 31, thereby being limited in the two ends of the outer sliding groove 232 (namely accommodated in the two ends of the outer sliding groove 232) in a slidable manner respectively. Thus, the two ends of the sliding groove 313 can only slide inside the two ends of the outer sliding groove 232. It should be noted that longer pivoting rod 312 and sliding rod 313 are beneficial to the transmission of the pressing force of the keycap 1. In this embodiment, the sliding rod 313 is limited in the sliding groove 23 and slides on the membrane circuit board 42. That is, the action area of the membrane circuit board 42 corresponding to the sliding rod 313 is not formed with any hole and is suitable for circuit layout. This makes the circuit layout of the membrane circuit board 42 easier. Furthermore, the plate sheet 311 of the disclosure is a complete sheet so its structural strength is sufficient and the overall structure of the connecting member 31 is simple. This is ideal for plastic molding and may achieve preferred yield rate and preferred precision, which reduces manufacturing time and costs dramatically. Compared to prior art, this is more suitable for keyboard structure of slim design. Also, the connecting member 31 and the frame body 2 may be made of nonmetal materials so the sliding rod 313 of the connecting member 31 sliding on the sliding groove 23 of the frame body 2 would not cause the problem of prior art regarding the metal abrasion. This improves the durability of the key structure 100 and avoids the noise issue of the key structure 100 in action. In one specific embodiment of the disclosure, the overall structure of the connecting member 31 is made by injection molding.

Each connecting member 31 is aslant arranged between the keycap 1 and the frame body 2. In this embodiment, the gap between each connecting member 31 is wider at the top and gradually narrower till the bottom, as an example. As shown in FIG. 1, FIG. 2 and FIG. 3, any adjacent two pivoting rods 312 each have one end kept proximal to each other and maintain a gap there between (namely kept as close as possible without touching or interfering for improving the transmission of the pressing force between the adjacent two pivoting rods 312), while any adjacent two sliding rods 313 each have one end away from each other. The pivoting portions 12 of the keycap 1 are arranged correspondingly to the pivoting rods 312 so any adjacent two pivoting portions 12 each have one pivoting body 121 arranged proximal to each other (as shown in FIG. 3). Specifically, as seen in FIG. 4 and FIG. 6, the pivoting portion 12 and the sliding groove 23 connected by the same connecting member 31 are misaligned, and the sliding rod 313 of each connecting member 31 slides with respect to the corresponding sliding groove 23 and in a sliding direction (referring to FIG. 6, four arrows including a left arrow and a right arrow, along with front and back arrows not shown in the figure, represent four sliding directions). After pressed, each connecting member 31 inclines along the sliding direction.

The elastic member 5 is movably disposed between the connecting members 31 of the connecting assembly 3 and elastically supports between the bottom face of the keycap 1 and the membrane circuit board 42. This provides a return force for the pressed keycap 1 to return to the original position. In this embodiment, one end of the elastic member 5 supports the middle section 423 of the membrane circuit board 42.

Figure 5:
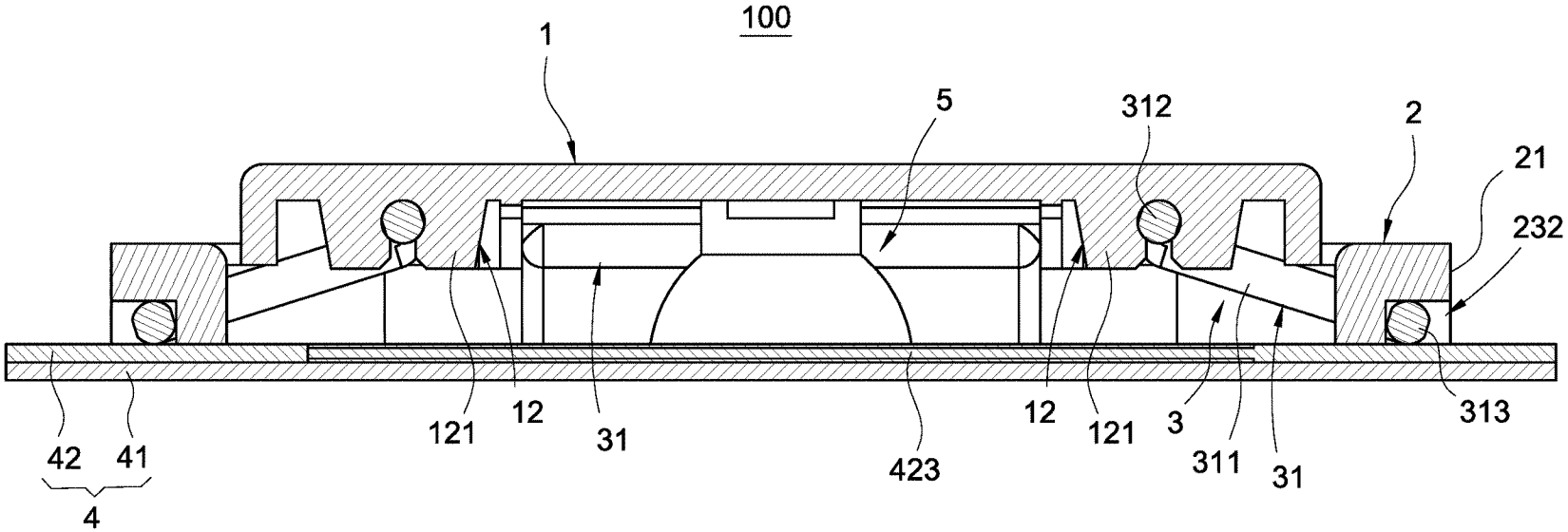
FIG. 5 is a sectional view of FIG. 3 along the cutting line 5-5.
Figure 6:
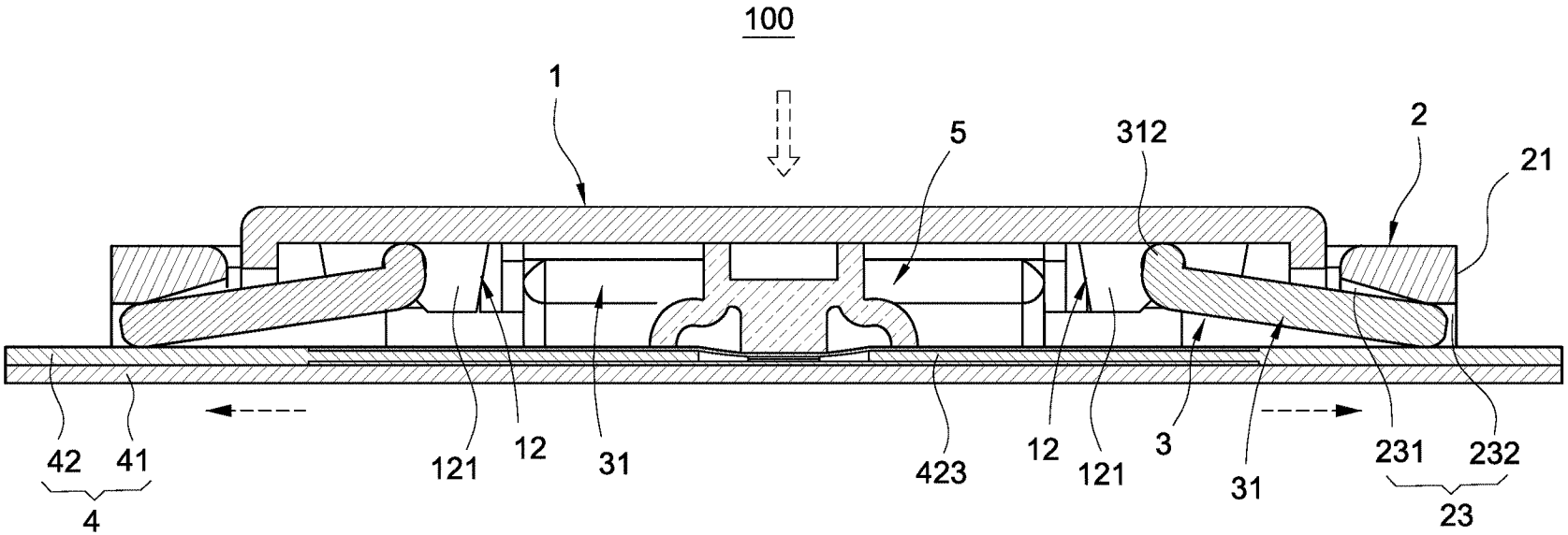
FIG. 6 is a sectional view of FIG. 4 after action.

As shown in FIG. 4, FIG. 5 and FIG. 6, when the keycap 1 is pressed by a finger, the keycap 1 drives the connecting assembly 3 to move towards the bottom plate 41, thereby making the plate sheet 311 of each connecting member 31 move along its sliding direction. In addition, the pivoting rod 312 of each connecting member 31 rotates relative to the corresponding pivoting portion 12, and the sliding rod 313 of each connecting member 31 slides in the corresponding sliding groove 23, from the inner edge 22 of the frame body 2 to the frame edge 21. The sliding rod 313 slides directly on the membrane circuit board 42. At this point, the keycap 1 moving downward relative to the bottom plate 41 forces the elastic member 5 to move downward accordingly and touch the membrane circuit board 42 for conduction, thereby triggering signal.

The pivoting rod 312 of each connecting member 31 is a complete rod structure. Hence, when the finger presses any edge part of the keycap 1, the pivoting rod 312 can utilize the complete rod structure to transfer the pressing force from one end of the pivoting rod 312 to the other end of the pivoting rod 312 (in a linear transmission). Further, each pivoting rod 312 has one end kept proximal to one end of the adjacent pivoting rod 312, thereby, via the keycap 1 as an medium, the two ends of the pivoting rod 312 can also transfer the pressing force to two adjacent pivoting rods 312 (in a U-shaped transmission). Lastly, the two adjacent pivoting rods 312, using the keycap 1 as an medium, can transfer the pressing force to the fourth pivoting rod 312 (in a rectangular transmission), thereby reaching the goal of evenly transferring the pressing force.

When the pressing force from the hand is released, the keycap 1 is returned to the normal state without being pressed by the elastic member 5. The keycap 1 is raised to its original position and thus drives the connecting assembly 3 to move. This makes the pivoting rod 312 of the connecting member 31 reversely rotates relative to the pivoting portion 12 and the sliding rod 313 reversely slide to the adjacent part of the inner sliding groove 231 and the outer sliding groove 232 (as seen in FIG. 3 and FIG. 5) and is stopped by the adjacent part of the inner sliding groove 231 and the outer sliding groove 232. Thus, a one-time pressing process is completed.

Additionally, the middle section 423 does not require forming any hole so the key structure 100 is of preferred performance regarding waterproof, dust-proof and circuit layout of the membrane circuit board 42. In this embodiment, the membrane circuit board 42 is only partially formed with holes 422 for fixing portions 25 to go through, as an example.

Moreover, the frame body 2 and/or each connecting member 31 are integrally formed, preferably by injection molding. Therefore, the advantages include stable structure, size easy to control and good precision. When being pressed, it is smooth and the pressing contact is reliable. The connecting member 31 may integrally form the pivoting rod 312 and the sliding rod in the round rod shape and this is beneficial to pivoting, lower abrasion and preferred fitting. The connecting member 31 may further be made of resin with the lubricating effect (for example, nylon) so it can be more ideal for sliding.

FIG. 7 and FIG. 8 show a key structure 100 of the second embodiment of the disclosure. The second embodiment is similar to the first embodiment, but the membrane circuit board 42 is further formed with openings, which are described below.

The parts of the membrane circuit board 42 corresponding to sliding grooves 23 each further form an opening so that each sliding rod 313 of the connecting member 31 is capable of sliding on the bottom plate 41 via the corresponding opening 421 and only in the range of the corresponding outer sliding groove 232. This reduces the height of the keycap 1 relative to the carrying body 4 so the key structure 100 and even the keyboard having the key structure 100 may be thinner. The middle section 423 of the membrane circuit board 42 is located between the openings 421 and the holes 422. In an alternative embodiment, the pivoting portions 12 mentioned before may be disposed on the bottom plate 41 instead and the sliding grooves 23 are disposed on the keycap 1. Thereby, the connecting members 31 each pivot on the bottom plate 41 and are slidably limited in the keycap 1.

Between the frame body 2 and the bottom plate 41 of the second embodiment, the fixing portion 25 of the frame body 2 may be in weld connection with the corresponding part of the bottom plate via the holes 422 of the membrane circuit board.

FIG. 9 and FIG. 10 show a key structure 100 of the third embodiment of the disclosure. The second embodiment is similar to the first or second embodiment, but the frame body 2 and the bottom plate 41 is fixedly connected by mounting structure. This is described below.

The mounting structure comprises a plurality of mounting members 211 disposed on the frame body 2 and a plurality of corresponding mounting members 411 disposed on the bottom plate 41. The mounting members 211 and the corresponding mounting members 411 are correspondingly mounted together respectively. The mounting member 211 are each preferably disposed on one of the frame edges 21 of the frame body 2 while the corresponding counting members 411 are exposed corresponding to the position of the holes 431. Accordingly, the frame body 2 may utilize the mounting members 211 thereof correspondingly mounted on the corresponding mounting members 411 of the bottom plate 41 to be stably fixed to the bottom plate 41.

FIG. 11 shows a key structure 800 of the fourth embodiment of the disclosure. The fourth embodiment is similar to the first or second embodiment, but the keycap 1*b* of the third embodiment is a keycap of a multiple-width key, which is described below.

The cap edge 11 of the keycap 1*b* comprises two long cap edges 111 and the two short cap edges 112 each connected between two ends of one of the long cap edges 111. The shape of the frame body 2*b* corresponds to the shape of the keycap 1*b* so the frame edge 21 has long edges and short edges.

In the connecting members of the connecting assembly 3*b*, the connecting members 31 correspondingly connected to the short edges 112 are identical to the connecting members in the first, second or third embodiment. However, the connecting members 31*b* correspondingly connected to the long edges 111 are each modified into a long connecting member 31*b* with corresponding length. The carrying body 4*b* comprises a bottom plate and a membrane circuit board stacked on the bottom plate.

FIG. 12 shows a key structure 800 of the fifth embodiment of the disclosure. The fourth embodiment is similar to the fourth embodiment, but the connecting members connected to the long cap edges 111 in the fifth embodiment are different, which is described below.

In the connecting members, a single connecting member 31 is used to be correspondingly connected to the short cap edge 112. For the long cap edge 111, however, at least two connecting members arranged side by side are correspondingly connected to the long cap edge 111.

FIG. 13 shows a key structure 100 of the sixth embodiment of the disclosure. The sixth embodiment is similar to the first or second embodiment, but the sixth embodiment only has two connecting members 31 arranged opposite to each other, the membrane circuit board 42 is not formed with any hole or opening, and the frame body 2 and the carrying body 41 is fixedly connected via the welding structure. That is, the frame body 2 is welded to be connected to the corresponding parts of the carrying body 4 and this ensures a stable connection between the frame body 2 and the carrying body 4. In one embodiment of the disclosure which is not shown in the figures, each fixing portion 25 may be welded to be connected to the corresponding parts of the bottom plate 41 via the holes 422 of the membrane circuit board 42 (referring to FIG. 1) such that a stable connection between the frame body 2 and the carrying body 41 is ensured. FIG. 14 is a schematic view showing the appearance of the key structure 100 and/or 800 of the disclosure applying on a keyboard. As seen in the figure, the keyboard is arranged with at least one key structure 100 of the standard key and at least one key structure 800 of the multiple-width key.

Except for the aforementioned description, the disclosure, compared to prior art, further has the following advantages:

Since the frame body 2(2*b*) is in a surrounding frame shape and multiple connecting members are independent of each other and without the requirement to form holes for the elastic member 5, the overall design has preferred structural strength. In addition, all actions focus on the frame body 2(2*b*) so the movement of pressing is smooth and the pressing contact is reliable when being pressed. Each connecting member 31(31*b*) corresponds to the arrangement of each cap edge 11 of the keycap 1(1*b*) so they are not misaligned, which enables each connecting member 31(31*b*) to not form holes for avoiding elastic member 5.

The connecting member 31(31*b*) is a sheet structure (especially plate 311 which is a complete sheet) so that it has preferred structural strength and preferred supporting strength. When being pressed, the relative position between the pivoting rod 312 and the sliding rod 313 does not slant.

Since the connecting member 31(31*b*) has preferred structural strength and the overall structure of the connecting member 31(31*b*) is simple and is good for plastic molding, the yield rate and the precision are improved. Also, the manufacturing time and costs are significantly reduced, which meets the manufacturing requirement of the keyboard structure of slim design.

The frame body 2(2*b*) and/or each connecting member 31(31*b*) are integrally formed (preferably by injection molding) so the structure is stable, the size is easy to control and is precise. Thereby, the movement of pressing is smooth and the pressing contact is reliable when being pressed. The connecting member 31(31*b*) may integrally form the pivoting rod 312 and the sliding rod 313 in round rod shapes. This is good for pivoting and is of lower abrasion and preferred fitting.

Since the frame body 2(2*b*) and the connecting member 31(31*b*) are made of nonmetal materials, the sliding rod 313 sliding on the sliding groove 23 does not lead to metal abrasion. This effectively improves the durability of the key structure 100(800) and avoids noise during the action of the key structure 100(800).

The membrane circuit board 42 considerably reduce the number of its holes, or even does not have any hole (e.g., reducing/shirking the number/size of the melting structure or the mounting structure), so it has preferred waterproof, dust-proof performances and is ideal for the circuit layout of the membrane circuit board 42. This makes the circuit layout of the membrane circuit board 42 easier.

The connecting member 31(31*b*) is arranged correspondingly to each cap edge 11 of the keycap 1(1*b*) and the pivoting rod 312 (or the sliding rod 313), as a complete rod, is connected between the keycap 1(1*b*) and the frame body 2(2*b*). This improves the stability of the keycap 1(1*b*) during the pressing process and the pressing force from the human hand may be transferred evenly, which reduces the possibility of missing reaction when the pressing position of the hand slants.

The parts of the membrane circuit board 42 corresponding to the sliding groove 23 further form a plurality of openings 421 so the sliding grooves 313 slides on the bottom plate 41 via the openings 421. This reduces the height of the keycap 1(1*b*) relative to the carrying body 4(4*b*) so the key structure 100 and even the keyboard having the key structure 100 may be thinner.

This special design of the structure can be applied not only on the standard key but also the multiple key. When it is used on the multiple key, the improved stability of the pressing process is even more noticeable.

The descriptions illustrated supra set forth simply the preferred embodiments of the instant disclosure; however, the characteristics of the instant disclosure are by no means restricted thereto. All changes, alternations, or modifications conveniently considered by those skilled in the art are deemed to be encompassed within the scope of the instant disclosure delineated by the following claims.

What is claimed is:

1. A key structure, comprising:

a carrying body;

a frame body disposed on the carrying body, wherein the frame body is disposed with either a plurality of sliding grooves or a plurality of pivoting portions;

a keycap having a plurality of cap edges, wherein the keycap is disposed with the other of the plurality of sliding grooves and the plurality of pivoting portions; and at least two connecting members independent with each other, wherein the at least two connecting members are connected between the keycap and the frame body, corresponding to two of the cap edges opposite to each other, each of the at least two connecting members comprises a pivoting rod and a sliding rod, each pivoting rod pivots on one of the pivoting portions, and each sliding rod is slidably limited in one of the sliding grooves, wherein at least one of the two connecting members is a sheet structure and comprises a sheet, the sheet has two connecting edges opposite to each other and two lateral edges opposite to each other, the main bodies of the pivoting rod and the sliding rod are respectively connected to the two connecting edges of the connecting member, two ends of the pivoting rod protrude from the two lateral edges respectively and pivot on the pivoting portion, two ends of the sliding rod protrude from the two lateral edges respectively and are located inside the sliding groove;

wherein the number of the at least two connecting members is four, each connecting member, corresponding to one of the cap edges, is connected between the keycap and the frame body.

2. The key structure according to claim 1, wherein each pivoting portion is disposed on the keycap and each sliding groove is formed on the frame body.

3. The key structure according to claim 1, further comprising an elastic member disposed between the connecting members and elastically supported between the keycap and the carrying body.

4. The key structure according to claim 1, wherein the carrying body comprises a bottom plate and a membrane circuit board disposed on the bottom plate, the frame body is disposed on the membrane circuit board, and each sliding rod slides on the membrane circuit board.

5. The key structure according to claim 1, wherein the carrying body comprises a bottom plate and a membrane circuit board disposed on the bottom plate, the parts of the membrane circuit board corresponding to the sliding grooves are each formed with an opening, and the sliding grooves each slide on the bottom plate via the opening.

6. The key structure according to claim 1, wherein the pivoting portion and the sliding groove are misaligned, the sliding rod of each connecting member slides with respect to the corresponding sliding groove in a sliding direction, and the connecting member slants in the sliding direction.

7. The key structure according to claim 1, wherein the keycap is a keycap of the multiple-width key, the cap edges of the keycap comprise two long cap edges and two short cap edges each connected between the two long cap edges, a single one of the connecting members is used in a connection corresponding to one of the short cap edges, and at least two of the connecting members are arranged side by side in a connection corresponding to one of the long cap edges.

8. The key structure according to claim 1, wherein the keycap is a keycap of a multiple-width key, the cap edges of the keycap comprise two long cap edges and two short cap edges connected between the two long cap edges, each of the connecting members corresponding to the long cap edges each is a long connecting member having a corresponding length.

9. The key structure according to claim 1, wherein the carrying body comprises a bottom plate and a membrane circuit board disposed on the bottom plate, the membrane circuit board is formed with a plurality of holes, the frame body is connected to the bottom plate via the holes.

10. The key structure according to claim 9, wherein the frame body is in a welded connection with the bottom plate correspondingly via the holes.

11. The key structure according to claim 9, wherein the frame body is disposed with a plurality of mounting members, the bottom plate is disposed with a plurality of corresponding mounting members each corresponding to and fitting one of the mounting members, the corresponding mounting member are each exposed, corresponding to a position of one of the holes.

12. The key structure according to claim 1, wherein the frame body or each connecting member is integrally formed.

13. The key structure according to claim 12, wherein the sliding rod or the pivoting rod of each connecting member is a round rod.

14. A key structure, comprising:

a carrying body;

a frame body disposed on the carrying body, wherein the frame body is disposed with either a plurality of sliding grooves or a plurality of pivoting portions;

a keycap having a plurality of cap edges, wherein the keycap is disposed with the other of the plurality of sliding grooves and the plurality of pivoting portions; and at least two connecting members independent with each other, wherein the at least two connecting members are connected between the keycap and the frame body, corresponding to two of the cap edges opposite to each other, each of the at least two connecting members comprises a pivoting rod and a sliding rod, each pivoting rod pivots on one of the pivoting portions, and each sliding rod is slidably limited in one of the sliding grooves, wherein at least one of the two connecting members is a sheet structure and comprises a sheet, the sheet has two connecting edges opposite to each other and two lateral edges opposite to each other, the main bodies of the pivoting rod and the sliding rod are respectively connected to the two connecting edges of the connecting member, two ends of the pivoting rod protrude from the two lateral edges respectively and pivot on the pivoting portion, two ends of the sliding rod protrude from the two lateral edges respectively and are located inside the sliding groove;

wherein the number of the at least two connecting members is at least three, each connecting member, corresponding to one of the cap edges, is connected between the keycap and the frame body, and the pivoting portions are surroundingly arranged at the outside of the sliding grooves.

15. The key structure according to claim 14, wherein at least one connecting member is aslant arranged between the keycap and the frame body, any adjacent two pivoting rods each have one end kept proximal to each other and maintain a gap there between, and any adjacent two sliding rods each have one end away from each other.

16. The key structure according to claim 14, wherein each of the pivoting portions of the keycap comprises two pivoting bodies, two ends of one of the pivoting rods respectively pivot on the two pivoting bodies of one of the pivoting portions, the two pivoting bodies of the pivoting portion are spaced apart from each other, and any adjacent two pivoting portions each have one of the pivoting bodies arranged adjacent to each other.

17. The key structure according to claim 14, wherein the frame body has a plurality of frame edges and a plurality of inner edges corresponding to the keycap, the plurality of sliding grooves are formed corresponding to the frame edges respectively, each of the sliding grooves comprises an inner sliding groove connected to one of the inner edges and an outer sliding groove in communication with the inner sliding groove and corresponding to one of the frame edges, the sliding rods are limited in the outer sliding grooves respectively, and two ends of each of the outer sliding grooves protrude from two ends of one of the inner sliding grooves and accommodate two ends of one of the sliding rods respectively.

18. The key structure according to claim 17, wherein the parts of the frame body corresponding to the inner sliding grooves each have an inclined face, the inclined face gradually inclines from one of the frame edges towards the corresponding inner edge, and the connecting member slides along the inclined face.

* * * * *